United States Patent [19]

Dozier

[11] Patent Number: 4,830,630

[45] Date of Patent: May 16, 1989

[54] HERMETICALLY SEALED ELECTRICAL TERMINAL

[76] Inventor: Hilliard Dozier, Stubbs Mill Rd., Lebanon, Ohio 45036

[21] Appl. No.: 235,027

[22] Filed: Aug. 22, 1988

[51] Int. Cl.[4] ..... H01R 13/68

[52] U.S. Cl. ..... 439/622; 174/152 GM; 337/1; 439/736

[58] Field of Search ..... 439/621, 622, 736, 935; 174/152 GM; 337/1, 401, 405, 416, 417

[56] References Cited

U.S. PATENT DOCUMENTS

| | | | |
|---|---|---|---|
| 3,160,460 | 12/1964 | Wyzenbeek | 439/736 |
| 4,461,925 | 7/1984 | Bowsky et al. | 439/736 |
| 4,480,151 | 10/1984 | Dozier | 439/736 |
| 4,609,774 | 9/1986 | LeMieux et al. | 439/621 |
| 4,739,551 | 4/1988 | Bowsky et al. | 174/152 GM |

*Primary Examiner*—Gary F. Paumen
*Attorney, Agent, or Firm*—Frost & Jacobs

[57] ABSTRACT

An hermetically sealed terminal construction having a terminal pin assembly wherein inner and outer pin parts are interconnected by a fuse link surrounded by a protective capsule defining an expansion cavity, the terminal pin assemblies extending through and being hermetically sealed to sleeves forming part of the supporting base, including a dielectric sealing member which covers the protective capsules and contiguous portions of the adjoining pin parts, the sealing member being adapted to fracture upon rupture of the protective capsules caused by disintegration of the fuse links, thereby causing the adjoining pin parts and contiguous areas of the sealing member to separate from the remainder of the terminal, thereby cutting off the flow of current through the terminal.

16 Claims, 5 Drawing Sheets

HERMETICALLY SEALED ELECTRICAL TERMINAL

This invention relates to electrical terminals and more particularly to an hermetically sealed electrical terminal of the type wherein one or more conductor pins project through sleeve-like openings in the body of the terminal and are secured to the terminal by means of seals which hermetically seal the pins against the exchange of atmosphere between the opposite sides of the terminal body.

BACKGROUND OF THE INVENTION

Hermetically sealed terminals have been widely used for many years in refrigeration equipment, wherein an electrical connection is made with component mounted within a sealed receptacle. In the case of refrigeration headers, the motor-compressor units are hermetically sealed and are normally located outside the building they are intended to heat or cool. Normally these units are very reliable and operate without difficulty over many years of service and, in general, are quite safe when installed, serviced and inspected by trained professional personnel. Even under these conditions, however, there is an occasional dangerous explosive venting of the motor-compressor receptacle through the electric terminal, the terminal seals being arced-away or shattered by explosive forces generated within the sealed system. If the explosive venting occurs when no one is close to the system, the resulting fumes, odor and/or flames, which are rapidly propelled through the openings in the terminal body, would be of concern, but not necessarily injurious. This is not always the case, however, and numerous injuries have resulted from ruptured terminals.

While various safety devices have hitherto been utilized to safeguard against dangerous venting of the refrigeration gases and oil, including the provision of thermal protectors which will shut down the motor-compressor unit if a predetermined internal circuit temperature is reached, none of these devices has proven to be wholly satisfactory. For example, a locked rotor will cause currents of approximately 5–6 times the rated load current of the unit to flow through the terminals to the motor winding. Because it is necessary for the external branch circuit fuses or circuit breakers to have a considerable time delay before they interrupt the current to the compressor (which delay is required for normal starting), these fuses and breakers do not rapidly trip to shut off the current to the unit. As a further complication, service personnel and homeowners sometimes attempt to restart the motor-compressor unit by installing slow-blow fuses of much higher amperage than recommended, or use no fuses at all—just copper bars or alligator clips for supplying current directly to the unit.

If during attempted startup the motor-compressor unit is in a major fault condition, any of the foregoing conditions could result in very dangerous explosive venting of the contents of the sealed unit and at the same time provide considerable electric power for ignition of the venting materials.

Various other expedients have been proposed to overcome the problem, but none has been totally satisfactory. For example, various types of temperature responsive circuit interrupters have been proposed for incorporation in the terminal itself. One such device utilizes thermally sensitive pellets which act to release a spring-bias contact as the pellet melts. While effective, the current interrupting action is too slow in operation due to the relatively large mass of material which must be melted and caused to flow before the gap between the conductive members is at the maximum. While efforts have been made to enhance the sensitivity of such devices and provide fast-tripping action, such efforts have not been totally successful in shutting down the motor-compressor before blow-outs occur.

In contrast to the foregoing, the present invention provides a terminal construction which provides for substantially instantaneous cut-off of current when a predetermined current induced temperature level is reached, including a unique pin construction whereby portions of the terminal pins are physically separated from the remainder of the terminals while maintaining the integrity of the hermetic seals.

SUMMARY OF THE INVENTION

An analysis of past failures of hermetically sealed terminals leads to the conclusion that undesirable venting or blow-out of the terminals occurs because of several factors:

(1) Very high currents passing through the terminal due to major shorts or contamination.

(2) The high currents and/or contamination cause very high temperatures and arcing over the internal surfaces of the terminal.

(3) In the case of terminals utilizing glass-to-metal seals, the very high current induced temperatures cause the glass seals to become more conductive and thereby accelerate the temperature build up until the physical strength and integrity of the seal is explosively lost.

(4) In the case of so-called "soft-seal" terminals wherein the terminal pins are sealed using various distortable dielectrical materials, the seal is gradually arced away until failure results.

In order to prevent these potentially catastrophic failures, the present invention provides a terminal construction wherein the terminal pins are formed by inner and outer pin parts interconnected by a high-temperature, high-current fuse link formed from a silver alloy which will melt and/or vaporize when heated to a predetermined temperature, thereby rapidly breaking the electrical connection between the inner and outer pin parts. Preferably, the fuse link will be formed from a silver alloy having a melting point in the range of 1100°–1450° F., although it will be understood that the melting point and current carrying capacity of the fuse link will be chosen in accordance with the electrical characteristics of the device being operated. For example, in the case of a refrigeration header, the fuse link will be sized to carry current equal to the locked rotor amperage of the compressor for a continuous time period in excess of three minutes and a current of two times the locked rotor amperage for approximately two to six seconds.

The fuse link and the adjacent ends of the inner and outer terminal pins are surrounded by a protective capsule which provides an air space or cavity surrounding the fuse link, the cavity providing space for the melted or vaporized fuse link material to migrate, thereby assuring clean separation of the pin parts. In cases where a major fault occurs, as where very high short circuit currents are encountered, the vaporization of the fuse material is extremely rapid and very high internal capsule pressures will result. To assure rapid current cut-off, the capsule is designed to be popped apart and separated, thereby physically separating one of the pin parts of the terminal pin from the other pin part and the body of the terminal, such separation of the parts serving to prevent continuous arcing and to exhaust the built-up capsule pressure, thereby cutting off current flow without destroying the integrity of the hermetic seal.

In accordance with the invention, either the inner or the outer pin part may be separated from the remainder of the terminal, although preferably the terminal will be constructed so that the outer pin part will separate, thereby giving a visual indication that there has been a major fault condition. To ensure the desired separation of the pin parts, the capsule is preferably formed in two parts, the first comprising a cup-like body adapted to receive one of the pin parts, the body being closed by a cap adapted to make snap-lock connection with the body, the cap engaging the other pin part. When pressure builds up in the capsule due to fuse vaporization, the path of least resistance is through the cap and the areas of the sealing member surrounding the cap, which effectively blows-away the cap, the adjacent pin part and the surrounding areas of the sealing member.

The terminal construction of the present invention may be utilized with either "soft-seal" terminals wherein the terminal pins are mounted to the terminal body by means of a dielectric material which is molded in situ to the body and pins, or utilizing "hard seal" techniques wherein the pins are mounted in the terminal body by means of glass-to-metal or ceramic-to-metal seals. Where "hard seals" are utilized, at least one side of the terminal body, including the fuse links and the protective capsules, will be encased in a molded in situ dielectric sealing material.

DESCRIPTION OF THE PREFERRED EMBODIMENTS

Figure 1:
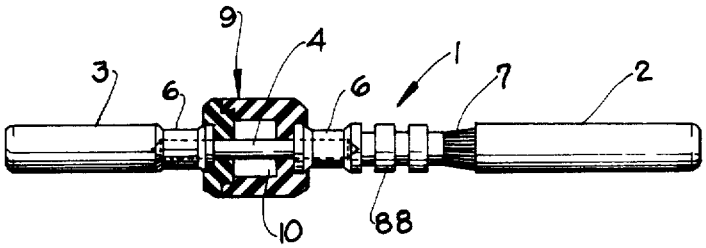
FIG. 1 is a plan view with parts in section of a terminal pin assembly in accordance with the invention.

As seen in FIG. 1, the terminal pin assembly, indicated generally at 1, comprises a first or inner pin part 2 and a second or outer pin part 3 interconnected by a fuse link 4. Preferably, the pin parts 2 and 3 will be formed from a copper alloy, whereas the fuse link will be formed from a silver alloy. In the embodiment illustrated, the fuse link is cylindrical and is adapted to have its opposite ends received in axial bores 5 in the pin parts 2 and 3, with the inner ends of the pin parts crimped about the ends of the fuse link, as indicated at 6, thereby ensuring positive electrical contact between the pin parts and the fuse link. The fuse link need not be cylindrical, but rather may be formed as a flat strip or of other configuration, such as a rectangular bar. To this end, the bores 5 in the pin parts can be configured to conform to the configuration of the fuse link, or the opposite ends of the fuse link can be configured to be received in the bores 5.

Preferably, the inner pin part 2 will be provided with a tapered knurled portion 7 which will assist in preventing rotation of the pin part, as well as provide an enlarged surface area which will tightly bond to the sealing member in which the terminal pin assembly is mounted. The inner pin part 2 also may be provided with one or more enlarged shoulders 8 which further enhance the surface area of the bond with the sealing member and additionally serve to resist contraction of the sealing material during curing.

In accordance with the invention, the terminal pin assembly incorporates a protective capsule, indicated generally at 9, which surrounds the fuse link 4, the capsule extending between and seating against the inner ends of the pin parts 2 and 3, the capsule including an air space 10 surrounding the central portion of the fuse link 4. The air space is important in that it provides a cavity in which the fuse link material may migrate when it melts or is vaporized by current-induced high temperatures, thus cutting off current flow.

Figure 2:
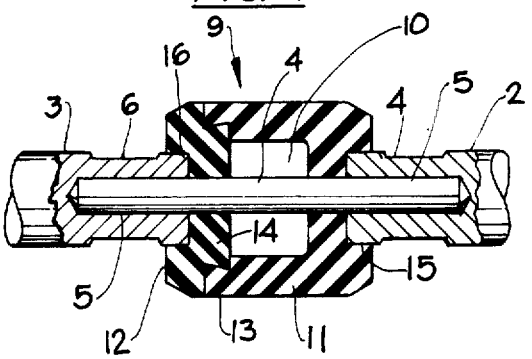
FIG. 2 is an enlarged fragmentary plan view of the center portion of the terminal pin assembly.

In cases where a major fault causes very high currents to flow, and the vaporization of the fuse material is very rapid, extremely high internal capsule pressures result. In order to prevent continuous arcing and temperature build-up, the protective capsule 9 is designed to be popped apart and is preferably formed in two parts which, as best seen in FIG. 2, comprise a cup-like body 11 and a cap 12 adapted to be snap-fitted to the open end of the cup-like body 11. To this end, the body 11 and cap 12 are provided with mating undercut shoulders 13 and 14 which provide an interlock. Preferably, the body and cap will be formed from a high temperature plastic material, such as 6—6 Nylon or Polycarbonate, which is sufficiently strong to prevent collapse during the molding of the conductor pin assemblies to the terminal body. In this connection, the terminal pin assembly, i.e. the inner and outer pin parts, the fuse link, and the protective capsule will be pre-assembled to the condition shown in FIG. 1 prior to assembly with the body of the terminal. Preferably, the inner ends of the pin parts 2 and 3 will seat in mating recesses 15 and 16 formed in the cup-like body 11 and cap 12, respectively.

Figure 3:
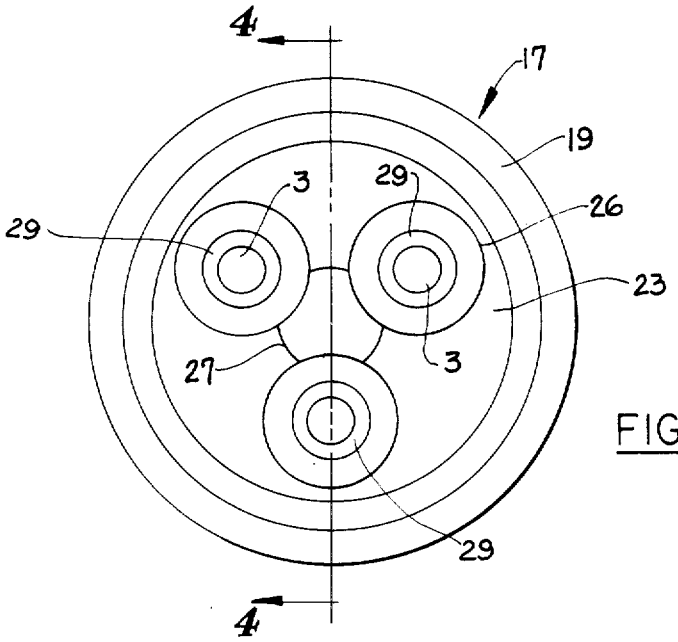
FIG. 3 is a top plan view of a terminal header incorporating the invention.
Figure 4:
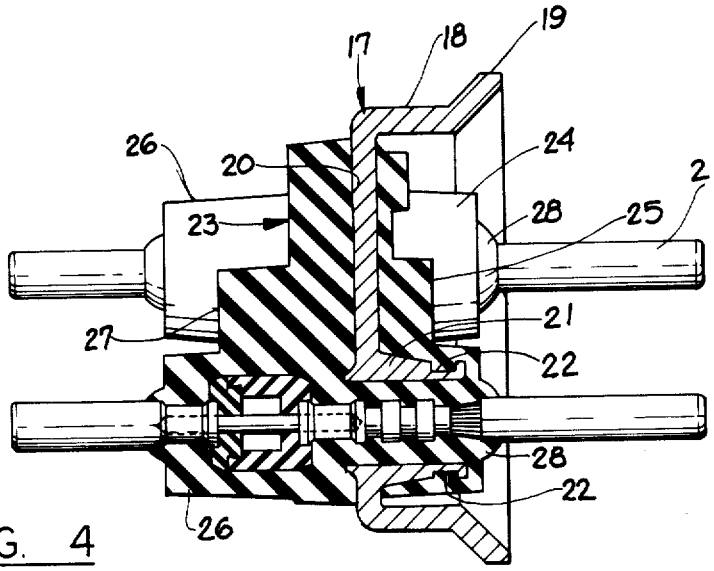
FIG. 4 is a vertical sectional view taken along the line IV—IV of FIG. 3.

Referring next to FIGS. 3 and 4, the terminal body, indicated generally at 17, is of shallow cup-shaped configuration, having an annular body wall 18 terminating at its outermost end in an out-turned mounting flange 19 and at its innermost end in a base 20 interrupted by spaced apart integral sleeves 21 lying within the confines of the annular body wall 2. The configuration of the terminal body 17 is conventional for a three-pin terminal and can be formed of any suitable material, although for most installations a steel body is preferred since it is inexpensive and can be readily formed into the desired shape. The particular material from which the body member is formed is normally determined by the mode of installation of the terminal, depending upon whether it is to be welded, soldered, braised, threaded, press-fitted or adhesively secured in place. The configuration of the sleeves 21 does not constitute a limitation upon the invention, and they may be of cylindrical or tapered configuration, or otherwise configured to effectively increase the area of interface between the sealing material and the terminal body, so as to inhibit the formation of leakage paths from one side of the terminal to the other due to thermal expansion and contraction of the parts. To this end, and as shown in FIG. 4, the distal ends of the sleeves 21 may be relieved and flanged, as indicated at 22.

In the embodiment of FIGS. 3 and 4, the terminal pin assemblies 1 are mounted in the sleeves by means of a sealing member or insulator 23 which hermetically seals the terminal pin assemblies to the terminal body 17. The sealing member 23 is preferably formed as a unitary body composed of a dielectric material molded in situ to the desired configuration, the sealing member being bonded to both sides of the base 20.

Various known sealing materials may be used, such as epoxy molding compounds marketed under the trademark Epiall. On the inner side of the terminal body, the sealing member includes annular enlargements 24 which surround the sleeves 21 and adjacent areas of the inner pin parts 2, together with an enlarged central portion 25 interconnecting the sleeve-surrounding annular enlargements 24. On its outerside, the sealing member 23 is provided with similar annular enlargements 26 which surround the protective capsule 9 and adjoining portions of the outer pin parts 3. The outer side of the sealing member 23 also includes an enlarged central portion 27 which interconnects the annular enlargements 26. If desired, the annular enlargements 24 and 26 may be provided with integral collars 28 and 29 surrounding the inner and outer pin parts 2 and 3, respectively, at the points where the pin parts emerge from the enlargements, the collars acting to relieve stress concentrations which could result in aging cracks in the peripheral areas of the seals immediately surrounding the pin parts. The collars additionally serve as seats for a plug other connector for receiving the pin parts. It will be understood that the pin parts may be provided with conventional conductor tabs at one or both ends, as may be required for a particular installation.

Figure 5:
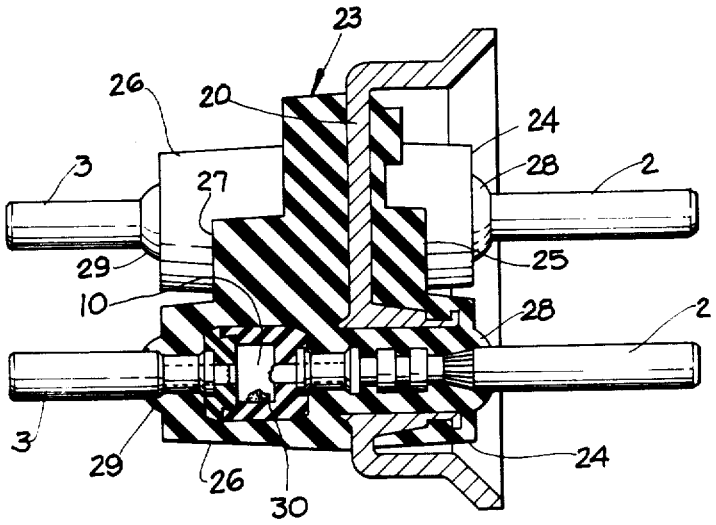
FIG. 5 is a vertical sectional view similar to FIG. 4 illustrating the condition of the parts upon melting of the fuse link.

In the event one or more of the terminal pin assemblies is subjected to a major fault condition, the fuse links 4 for such pins will melt or vaporize in the area of cavity 10 in the protective capsule 9, such condition being illustrated in FIG. 5 wherein the fuse link residue is indicated at 30. The disintegration of the fuse link cuts-off current flow through the terminal pin and hence to the compressor motor.

Figure 6:
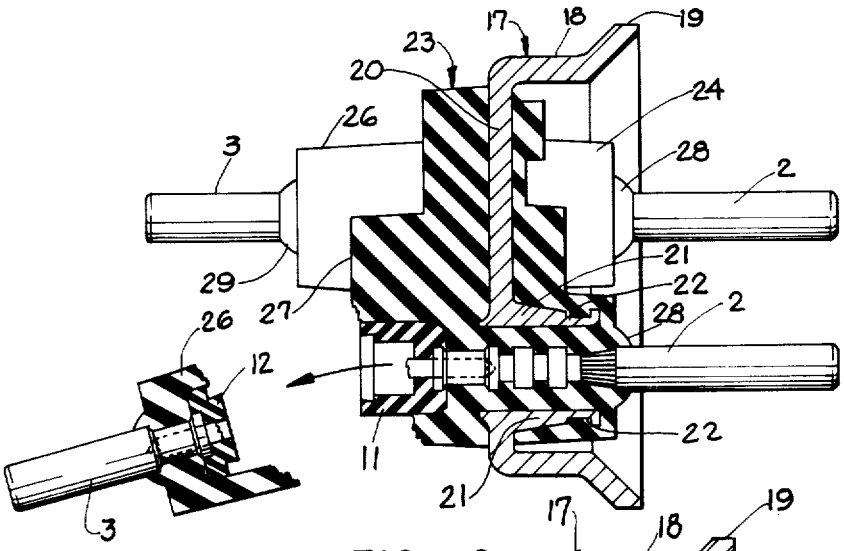
FIG. 6 is a vertical sectional view similar to FIG. 5 showing the manner in which external portions of the terminal have been separated from the remainder of the terminal under major fault conditions.

In cases where a major fault causes very high currents to flow, and the vaporization of the fuse material is extremely rapid, extremely high internal pressures will be generated within the capsule 9. In order to relieve this pressure in a manner which will prevent venting of the terminal and yet positively cut off current flow, the protective capsule is designed to be separated, the pressure generated in the cavity 9 causing the cap 12 to be blown away, carrying with it portions of the surrounding annular enlargement 26 and the outer pin part 3. This action is illustrated in FIG. 6. While the precise areas of fracture may vary, fracture will normally occur along the annular walls of the enlargements 26 which are relatively thin and hence offer less resistance to rupture than other areas of the sealing member. Even though the terminal is effectively destroyed insofar as future use is concerned, it nonetheless maintains its integrity in that a blow-out of the sealing material within the sleeves 21 is prevented. After separation, any exposed portion of the inner pin part 2 is encased by the cup-like body 11, or if the cup-like body is also dislodged, the exposed portion of the inner pin part is essentially flush with the remainder of the sealing member and hence cannot serve as a usable contact should service personnel attempt to reconnect the terminal.

Figure 7:
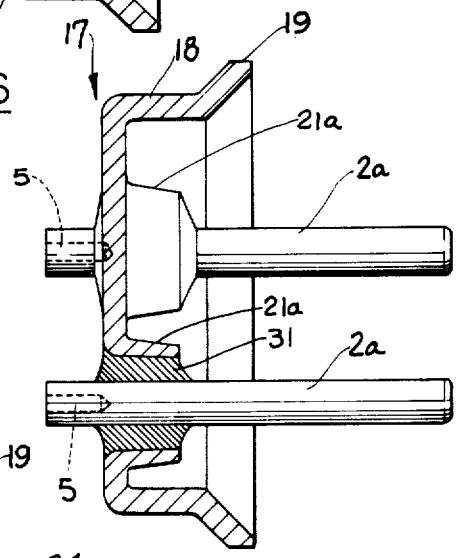
FIG. 7 is a side elevational view of a terminal utilizing glass-to-metal seals in partially assembled condition.
Figure 8:
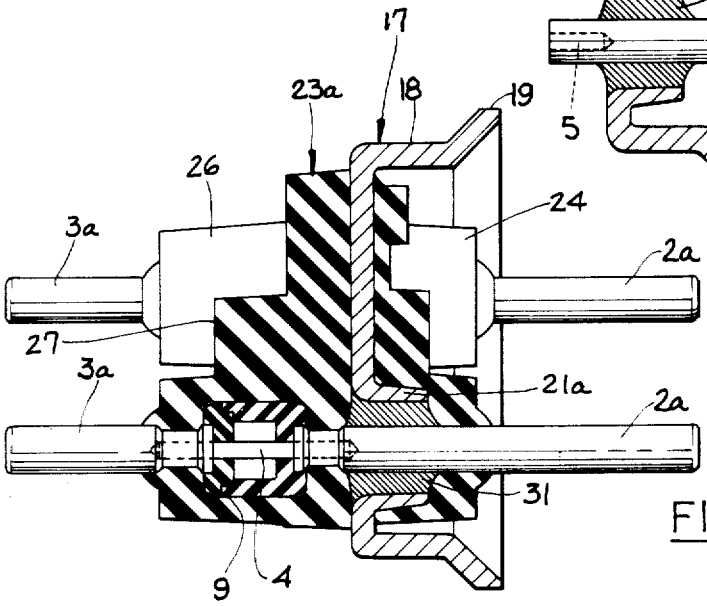
FIG. 8 is a side elevational view of the terminal of FIG. 7 in the fully assembled condition.
Figure 9:
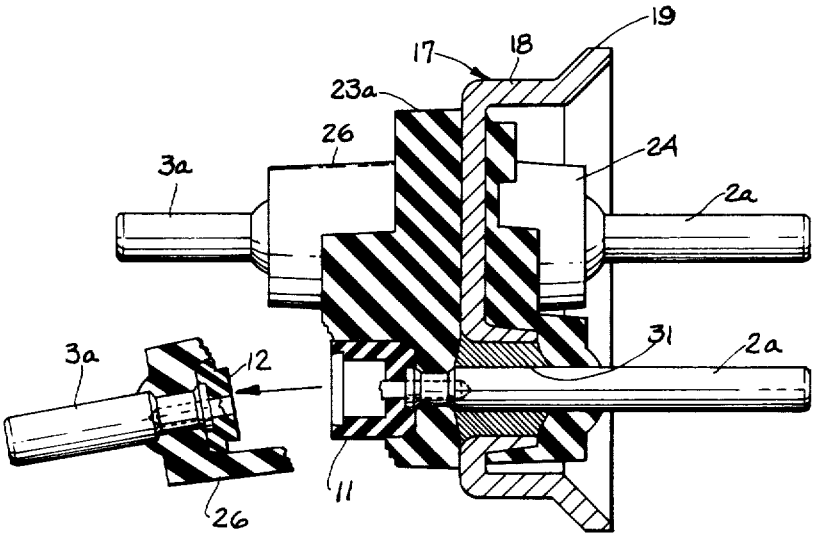
FIG. 9 is a side elevational view of the terminal of FIG. 8 showing the separation of the outer portion of one of the terminal pins.

Referring next to FIGS. 7–9 which illustrate an alternative embodiment of the invention utilizing glass to metal seals, and wherein like parts have been given like reference numerals, the inner pin parts **2*a* will comprise steel pins, such as high conductivity copper core steel pins, which are necessitated by the fact that their coefficient of expansion is compatible with the glass seals 31 utilized to secure the inner pin parts 2*a* to the levels 21*a* in the terminal body 17. In this embodiment, the inner pin parts 2*a* are first assembled in the manner shown in FIG. 7, whereupon the terminal pin assemblies are then completed by the attachment of the fuse links 4, the protective capsules 9 and the outer pin parts 3*a*. When the terminal pin assemblies are completed, the sealing member 23*a* is molded in situ to the terminal body 17, thereby completing the terminal, which takes the configuration shown in FIG. 8. Since the inner pin parts 2*a* are sealed to the terminal body 17 by the glass seals 31, it is necessary to fill the mold for the sealing member 23*a* from both sides of the terminal body. It may be noted, however, that it is not absolutely necessary to have the sealing member 23*a*** cover the inner side of the terminal body since the terminal is already sealed with glass. However, it is preferred to include the internal portion of the sealing member since it significantly increases the over-surface path to ground and requires much more internal contamination before arcing can occur.

In use, the terminal of FIGS. 7–9 will perform in the same manner as the emodiment shown in FIGS. 1–6, the parts separating in the manner illustrated in FIG. 9 when one or more of the pin assemblies is subjected to fault conditions.

Figure 10:
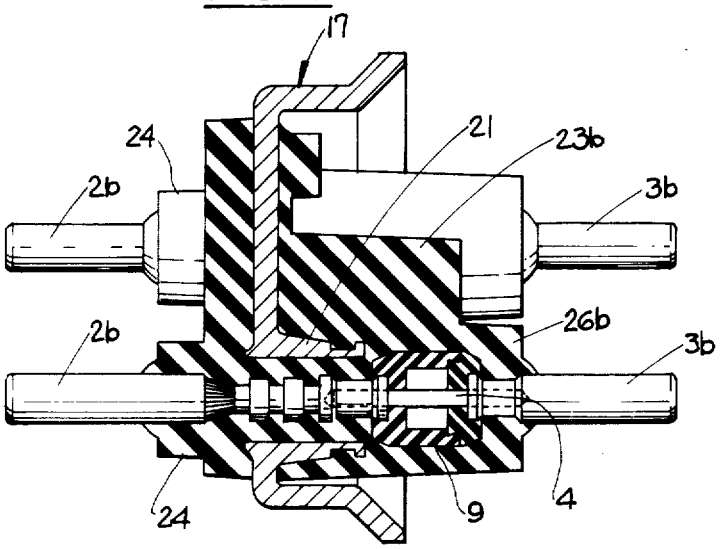
FIG. 10 is a vertical sectional view similar to FIG. 4 illustrating a terminal in which the terminal pin assembly is reversed so that the inner pin part will break away.

As seen in FIG. 10, the position of the terminal assemblies may be reversed so as to locate the fuse link 4 and capsule 9 on the inside of the terminal body 17, in which event the outer pin parts 3 become the inner pin part **3*b* and the inner pin parts 2 become the outer pin parts 2*b*. Similarly, the positions of the sealing member 23*b* will be reversed so that the enlargements 26*b* will surround the protective capsules 9. While in this instance the inner pin part 3*b* will separate on the inner side of the terminal body, the annular enlargement 26*b* will fracture in the same manner as shown in FIG. 6, thereby maintaining the integrity of the hermetic seals in the areas of the sleeves 21** while breaking the circuit between the pin parts.

Figure 11:
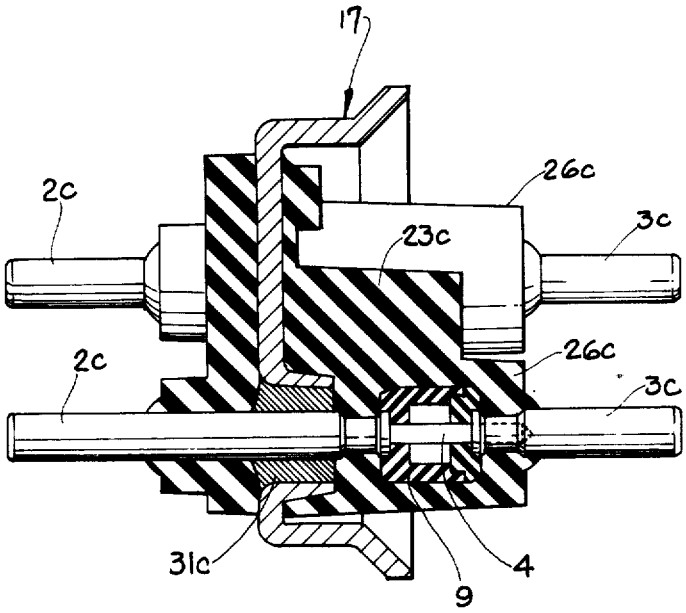
FIG. 11 is a vertical sectional view similar to FIG. 8 showing a reversed terminal pin assembly with a glass-to-metal seal.

In like manner, and as seen in FIG. 11, the construction of the glass-to-metal hermetically sealed terminal of FIGS. 7 and 8 may be reversed, in which event the inner pin parts 2*a* become the outer pin parts 2*c* and the outer pin parts 3*a* become the inner pin parts 3*c*. In this instance, the outer pin parts 2*c* will be first sealed to the body 17 by the glass or ceramic seals 31*c*, whereupon the fuse links 4 and inner pin parts 3*c* on the inner side of the terminal body will be assembled and the sealing member 23*c* molded in situ with the enlargements 26*c* surrounding the capsules 9 and adjacent portions of the pin parts 3*c*.

As should now be evident, the instant invention provides hermetically sealed terminals which have been found to effectively eliminate the blow-out problems which have hitherto been encountered with both glass seal and so-called soft seal terminals when subjected to major fault conditions.

What is claimed is:

1. An hermetically sealed terminal construction comprising, a terminal body comprising a base having inner and outer sides and at least one annular opening therein defined by a sleeve projecting outwardly from the inner side of said base, a terminal pin assembly adapted to be mounted on said base, said terminal pin assembly comprising a pair of pin parts lying in axially spaced relation to each other, a fuse link interconnecting the inner ends of said pair of pin parts, and a protective capsule surrounding said fuse link and engaging the inner ends of said pin parts, said capsule defining an expansion cavity surrounding said fuse link, said capsule being adapted to rupture upon the build-up of pressure in said cavity caused by current induced disintegration of said fuse link, and sealing means securing said terminal pin assembly to said terminal body, with a first of said pin parts extending centrally through said sleeve, and the other of said pin parts and said capsule projecting beyond said sleeve, a first component of said sealing means lying within said sleeve and providing an hermetic seal between said first pin part and said terminal body, a second component of said sealing means comprising a sealing member covering at least one side of said terminal body and surrounding and covering said protective capsule and contiguous portions of the other of said pin parts, said sealing member being adapted to be fractured upon rupture of said protective capsule to separate the other of said pin parts and contiguous areas of said sealing member from the remainder of said terminal.

2. The hermetically sealed terminal construction claimed in claim 1 wherein the first component of said sealing member comprises a glass-to-metal seal, and wherein said second component comprises a molded dielectric sealing member.

3. The hermetically sealed terminal construction claimed in claim 1 wherein said first component of said sealing means comprises a molded dielectric sealing material integral with said second component.

4. The hermetically sealed terminal construction claimed in either of claims 2 and 3 wherein said sealing means includes a third component comprising a molded dielectric sealing member covering the remaining side of said terminal body and adjacent portions of said first pin part.

5. The hermetically sealed terminal construction claimed in claim 1 wherein said protective capsule comprises a cup-shaped body having a removable cap at one end thereof.

6. The hermetically sealed terminal construction claimed in claim 5 wherein said cup-shaped body and said removable cap have mating undercut shoulders, whereby said cap is snap-fitted to said body.

7. The hermetically sealed terminal construction claimed in claim 5 wherein said protective capsule is formed from a plastic material, and wherein the walls of said capsule are sufficiently rigid to resist collapse during formation of said surrounding sealing member.

8. The hermetically sealed terminal construction claimed in claim 1 wherein the inner ends of said pin parts have axial bores therein sized to receive the opposite ends of said fuse link, and wherein the inner ends of said pin parts are crimped about the opposite ends of said fuse link.

9. The hermetically sealed terminal construction claimed in claim 8 wherein said protective capsule has recesses in its opposite ends adapted to receive the inner ends of said pin parts.

10. The hermetically sealed terminal construction claimed in claim 1 wherein said sealing member has an annular enlargement surrounding said protective capsule and the contiguous portion of said other pin part, and includes an integral collar at the outer end of said annular enlargement.

11. The hermetically sealed terminal claimed in claim 10 wherein said sealing means includes a sealing member component covering the remaining side of said terminal body, said sealing member component having an annular enlargement surrounding a portion of said first pin part, including an integral collar at the outer end of said last-named annular enlargement.

12. The hermetically sealed terminal construction claimed in claim 1 wherein said terminal body has a plurality of sleeves therein, and wherein a terminal pin assembly is mounted in each of said sleeves.

13. A terminal pin assembly for use in an hermetically sealed terminal, said assembly comprising:

a first pin part, a second pin part lying in axially spaced relation to said first pin part, a fuse link interconnecting said first and second pin parts, and a protective capsule surrounding said fuse link and engaging the adjoining ends of said first and second pin parts, the surrounding walls of said capsule being spaced from said fuse link to define an expansion chamber, said capsule being adapted to rupture upon the build-up of pressure in said expansion chamber caused by rapid disintegration of said fuse link.

14. The terminal pin assembly claimed in claim 13 wherein said protective capsule comprises a cup-shaped body having a removable cap at one end thereof.

15. The terminal pin assembly claimed in claim 14 wherein said cup-shaped body and said removable cap have mating undercut shoulders whereby said cap is snap-fitted to said body.

16. The terminal pin assembly claimed in claim 15 wherein said protective capsule is formed from a plastic material.

* * * * *